US005495791A

United States Patent [19]

Sande et al.

[11] Patent Number: 5,495,791

[45] Date of Patent: Mar. 5, 1996

[54] ACTUATOR FOR TRANSFER OF FORWARD AND BACKWARD ROTATIONAL MOVEMENT

[76] Inventors: Kurt Sande, Risløkka 47A, N-1600 Fredrikstad; Edgar J. Heim, Nymannsveien 165, N-4015 Stavanger; Torbjørn Staaland, Krystallveien 14, N-4875 Nedenes, all of Norway

[21] Appl. No.: 351,355

[22] PCT Filed: Jun. 7, 1993

[86] PCT No.: PCT/NO93/00089

§ 371 Date: Dec. 9, 1994

§ 102(e) Date: Dec. 9, 1994

[87] PCT Pub. No.: WO93/25818

PCT Pub. Date: Dec. 23, 1993

[30] Foreign Application Priority Data

Jun. 15, 1992 [NO] Norway ..... 92 2351

[51] Int. Cl.[6] ..... F01C 9/00

[52] U.S. Cl. ..... 92/120; 92/13.6; 92/128

[58] Field of Search ..... 92/165 R, 120, 92/67, 128, 13.6

[56] References Cited

U.S. PATENT DOCUMENTS

| | | | |
|---|---|---|---|
| 2,657,538 | 11/1953 | Myers | 92/120 |
| 2,936,636 | 5/1960 | Wacht | 92/120 |
| 2,996,049 | 8/1961 | Huska | 92/120 |
| 3,070,075 | 12/1962 | Hanselmann | 92/120 |
| 3,444,788 | 5/1969 | Sneen . | |

FOREIGN PATENT DOCUMENTS

| | | | |
|---|---|---|---|
| 503122 | 7/1949 | Canada | 92/120 |
| 98614 | 1/1984 | European Pat. Off. . | |
| 0000604 | 1/1983 | Japan | 92/120 |

*Primary Examiner*—Thomas E. Denion
*Attorney, Agent, or Firm*—Bell, Seltzer, Park & Gibson

[57] ABSTRACT

A fluid-operated actuator comprising a chamber part (1) with at least one chamber (12, 13), a carrier (3) which is rotatably mounted in the chamber part (1), and a plunger piston (2) in the form of a circular arc. The plunger piston can be moved along the circular arc and thereby rotate about the carrier's axis of rotation (50) since it extends in the chamber and is arranged to connect with the carrier (3). According to the invention the plunger piston (2) via a sealing device (32, 33, 42–45) is passed sealingly through an opening (14, 15) in the chamber (12, 13), there being a clearance between the surface of that section of the plunger piston which is located in the chamber and the chamber walls. Furthermore that section of the plunger piston which is located outside the chamber (12, 13) is supported along its radially outer surface by a support part (4) which is attached to the chamber part (1).

5 Claims, 2 Drawing Sheets

ACTUATOR FOR TRANSFER OF FORWARD AND BACKWARD ROTATIONAL MOVEMENT

The invention relates to a fluid-operated actuator comprising a chamber part with at least one chamber which can be supplied with a pressurized fluid, a carrier which is mounted in the chamber part in such a manner that it can rotate about an axis of rotation, and which can be connected with an object which has to be rotated, and a plunger piston whose longitudinal axis extends in the form of a circular arc, and whose axis, which extends through the centre of the circle and perpendicular to the circle plane, is coincident with the axis of rotation of the carrier, which plunger piston is arranged to be rotated about the axis of the rotation, and extends in the chamber, and to be connected with the carrier, where the plunger piston via a sealing device is passed sealingly through an opening in the chamber, and there is clearance between the surface of that section of the plunger piston which is located in the chamber and the chamber walls.

Actuators of this type can be used for the control and operation of valves and the like, for the operation of control organs in aircraft, as steering engines etc. However, such actuators have encountered difficulty in absorbing the large radial forces which are exerted without elastic deformation of the plunger piston and thereby its faulty positioning in relation to adjacent parts. Such deformation or faulty positioning can result in a deterioration in the efficiency of the parts and permanent damage to the chamber part or the plunger piston.

From EP 0098 614 there is known an actuator of the type which is mentioned in the introduction, wherein the forces which are caused by the hydraulic pressure and exerted against the piston, are counteracted by the carrier alone. The piston therefore will be exposed also to large bending moments. In addition to this unfavorable loading of the piston the resulting deflection of the piston makes a complicated, movable sealing device necessary at the places where the piston is introduced into the chamber part.

From U.S. Pat. No. 3,444,788 it is known that the plunger piston may be extended outside the chamber part in order to form a complete circular arc. Furthermore the plunger piston is designed as part of a central carrier part. In this case the radial forces are absorbed by the carrier part and special bearing elements provided in the cylinder part. However, a design of this kind is encumbered by the disadvantage that it has very limited working range. Moreover the carrier part is fixedly connected with the plunger piston, which causes problems during assembly and dismantling and when the actuator has to be connected to valve spindles which may be of varying length and diameter.

According to the applicant's Norwegian Patent No. 133 678 another device is known for absorbing and compensating for the large forces which can be exerted. A piston rod in the form of a circular arc with a rectangular cross section is connected with a short piston with a rectangular cross section. The piston is provided inside a cylinder which also has a rectangular cross section and which extends along a circular arc of 180 degrees. The piston rod extends outside the cylinder housing from one side of the piston to the other side thereof. In order to absorb and compensate for the radially exerted forces and thereby avoid destructive wear and tear, due, amongst other things, to the piston rod coming into contact with the end piece of the cylinder space, and to prevent the piston from seizing up, two opposite sides of the rectangular piston rod are provided in such a manner that they slide against two adjacent supporting walls in the cylinder space. By this means a large supporting surface and the possibility of transferring large motive forces is obtained. The cylinder space, the piston and the piston rod, however, have to be produced with extremely small tolerances, a process which is expensive and involves demanding work.

The object of the invention is to provide an actuator of the type described in the introduction which is not encumbered by the above-mentioned disadvantages.

The characteristics of the actuator according to the invention are characterized by the features in the claims presented.

The invention will now be described in more detail with reference to the drawing which illustrates schematically an embodiment of an actuator according to the invention.

Figure 1:
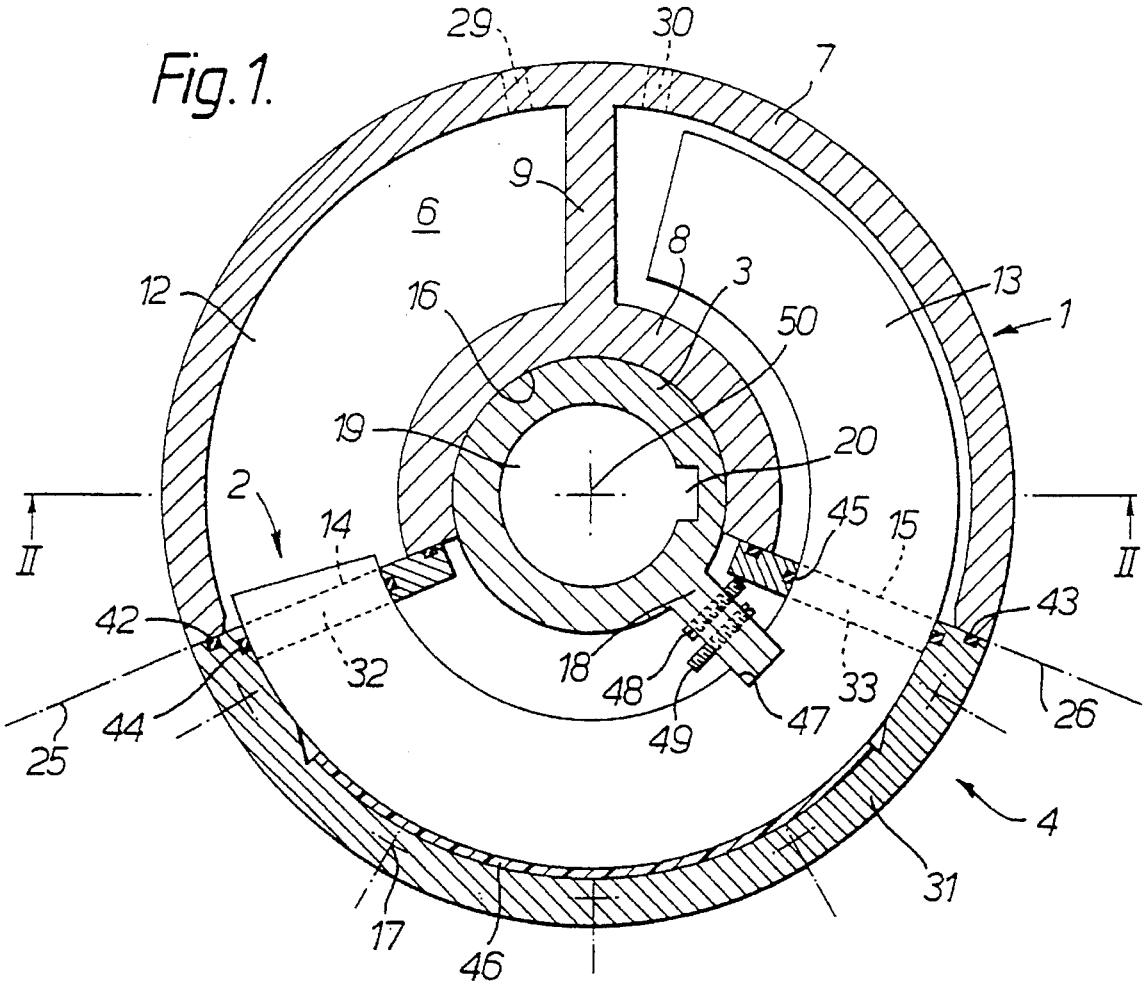
FIG. 1 shows a section along line I—I in FIG. 2 through an actuator according to the invention.
Figure 2:
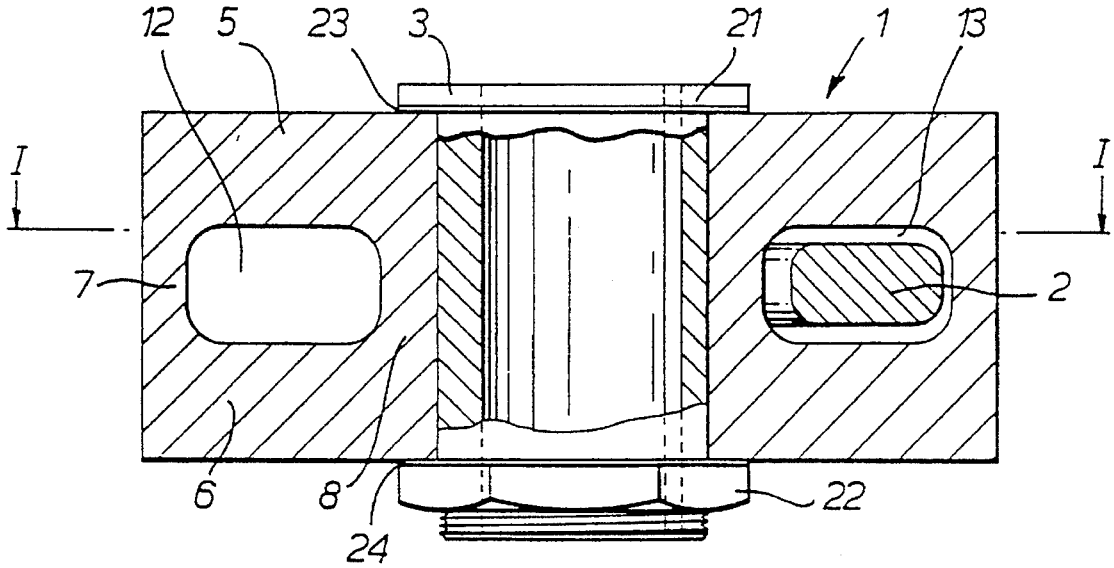
FIG. 2 shows a section along line II—II through the actuator illustrated in FIG. 1.
Figure 3:
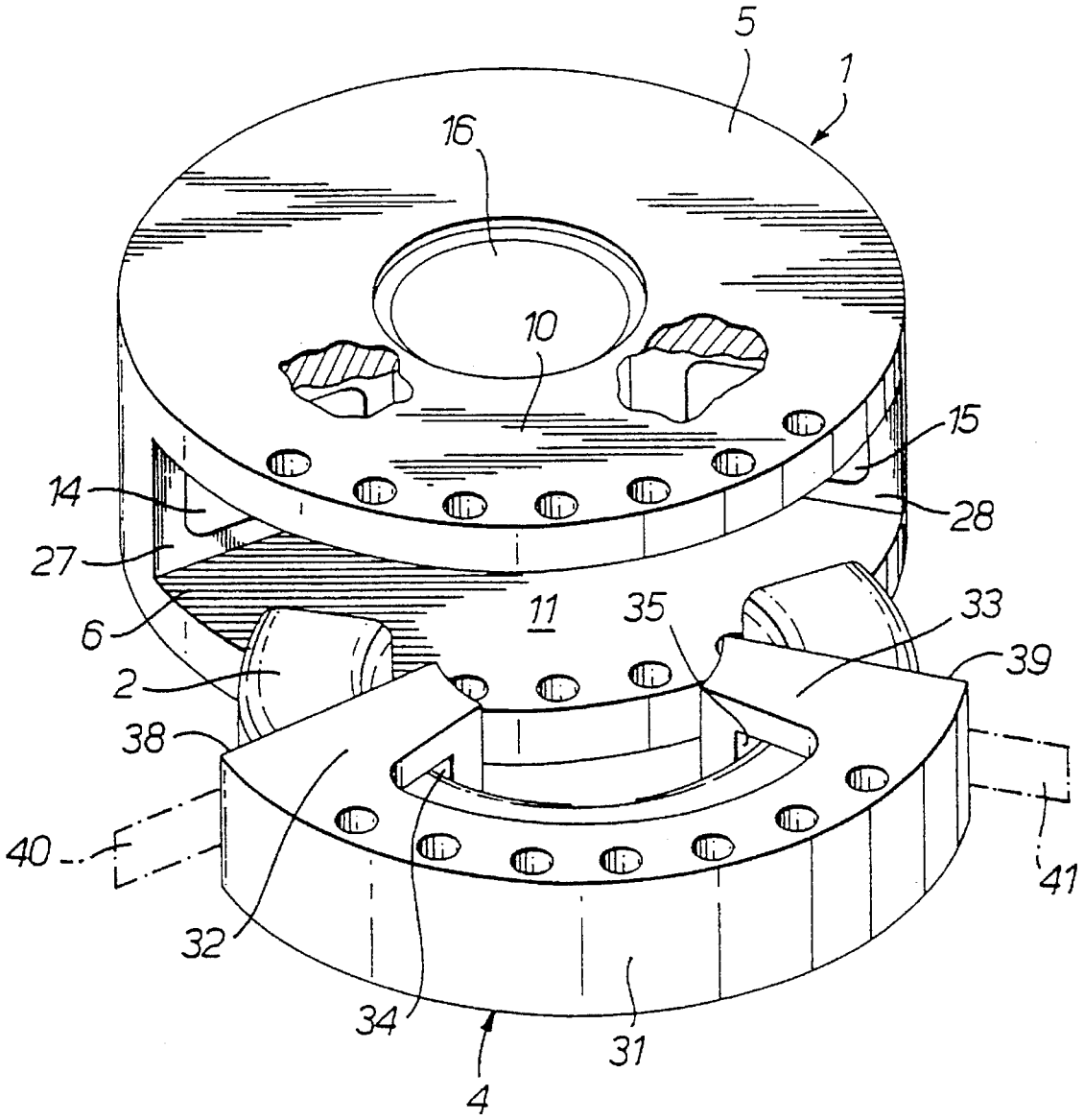
FIG. 3 is a perspective view of the actuator illustrated in FIGS. 1 and 2 where some components have been removed and remaining components have been drawn away from one another and sections have been cut away.

As the figures illustrate, the actuator comprises a chamber part 1, a plunger piston 2, a carrier 3 and a support device 4.

The chamber part 1 is substantially cylindrical and has an upper and lower circular, disc-shaped wall section 5, 6 which are interconnected via radially outer and inner wall sections 7 and 8 respectively having a form as coaxial, hollow, circular cylinder sections which are cut off by planes 25, 26 which extend with a mutual angular distance through the longitudinal axis 50 of the chamber part. In addition the wall sections 5, 6 are interconnected via a radially extending wall section 9 which is provided halfway between the above-mentioned planes, and which extends through the radially outer and inner wall sections 7, 8.

Thus the wall sections 5, 6, 7, 8 and 9 define two rectangular or square in cross section curved chambers 12, 13, which extend over an angular distance corresponding approximately to half the angular distance between the planes 25, 26, that section of the upper and lower wall sections 5, 6 which is not interconnected via the radially outer and inner circular sections constituting an upper and a lower flange or lip section 10, 11. The chambers 12, 13 have end openings 14, 15 which end in the end surfaces 27, 28 which extend in the planes 25, 26. Through the wall of each chamber there are provided bores 29, 30, via which the chambers can be connected to a pressurized fluid source or a return pipe for the pressurized fluid.

In the radially inner wall section 8 and the upper and lower wall sections 5, 6 there extends an axial, central bore 16 wherein there is rotatably mounted a carrier 3 with a radially extending arm 18 which projects between the end surfaces 27, 28. In the carrier there is further provided a central, axially extending bore 19 with an axially extending key way 20, the bore 19 and the key way 20 being provided to slidingly receive a valve stem or the like or a key which is connected with this (not shown) for rotating the valve stem by means of the carrier 3. One end section of the carrier 3 is supplied with a flange 21 whereby it rests on the upper wall section 5, and on the second end section which projects below the lower wall section 6 there are provided threads on to which is screwed a nut 22, whereby sliding discs 23, 24 may be provided between the flange and the nut and the adjacent wall sections.

The support part 4 comprises a supporting wall 31 which is provided as a section of a cylinder, which has approximately the same thickness and radius as the chamber part's radially outer wall section 7, and which has two sleeve-shaped end sections 32, 33. Thus in each end section 32, 33 there is provided a passage 34, 35 which ends in end surfaces 38, 39 which lie in respective planes 40, 41 which extend with a mutual angular distance which corresponds to the angular distance between the above-mentioned planes 25, 26. In each end surface 38, 39 there are provided tracks which extend around the openings 34 and 35 respectively and in which there is provided a packing 42 and 43 respectively, and in the passage 34, 35 there is provided a circular, radially inward facing track for a packing 44 and 45 respectively. The radially inward facing side of the support wall 31 is coated with an antifraction coating 46.

In that section of the upper and lower wall sections 5, 6 which is located close to the periphery of these and axially through the support part's supporting wall 31, there are provided holes for screws 17 which are indicated in the drawing by intersecting chain dotted lines, whereby the support part 4 can be secured to the chamber part 1 after it has been located between the lip sections 10, 11 and the chamber part's end surfaces 27, 28 have been caused to abut against the respective end surfaces of 38, 39 of the support part 4, the packings 42, 43 thus being sealingly located between the opposite end surfaces.

Instead of or in addition to the above-mentioned holes and screws, there may be provided, e.g., flanges with throughgoing screws at the end surfaces, whereby these can be firmly pulled together.

Through the passages 34, 35 of the support part 4 there is passed a plunger piston 2 whose longitudinal axis extends along a circular arc. The length of the plunger piston is so great that one of its end sections projects slightly into one of the chambers 12 when its second end section 13 is located close to the radially extending central wall 9 and vice versa. For example, the plunger piston can extend over a circular arc of 270 degrees. Moreover the end openings 14, 15 are so large and the plunger piston 2 adapted to the chamber part 1 in such a way that the plunger piston's end sections can be inserted into the chamber part's end openings 14, 15 when the support part 4 with the plunger piston passed through the end sections 32, 33 is located symmetrically in relation to an axial plane which extends halfway between the end openings 14, 15 and is inserted between the lip sections 10, 11 for assembly of the support part 1.

At its central section the plunger piston has a radially inward facing track 47 whose width is adapted to the width of the arm 18. During the said assembly the carrier 3 is placed in such a manner that the arm extends in this axial plane, thus causing the arm 18 to be simultaneously inserted into the track 47.

The arm 18 can be supplied with a device, e.g. two screws 48, 49, whereby the plunger piston's stroke can be adjusted, the two screws being arranged to abut against respective surface sections of the support part's 4 end sections 32, 33.

The method of operation of the actuator is as follows.

If, for example, the bore 30 of the chamber part 1 is connected with a pressurized fluid source and the bore 29 is connected with a return pipe for this, the hydrostatic forces which are caused by the fluid pressure against the plunger piston will compensate for one another apart from those forces which attempt to press the plunger piston out of the chamber opening 15 and into the opening 14. A valve spindle or the like which is rotatably connected with the carrier 3, will thereby be rotated until the plunger piston has been moved so far in a clockwise direction according to FIG. 1 that the adjusting screw 49 abuts against the support part's end section or sleeve 32.

By then connecting the bore 29 of the chamber part with the pressurized fluid source and the bore 30 with the return pipe, the plunger piston 2 will be moved in an anticlockwise direction and the valve spindle rotated until the adjusting screw 48 abuts against the support part's 4 end section 33. During the course of these movements of the plunger piston this is pressed against the support part's antifriction coating with a force corresponding to the force which is the resultant of the fluid pressure force and the counter force against this which is exerted by the carrier arm 18.

With this actuator, therefore, there is no need for any fine finishing of the chamber surfaces. Only the outer surfaces require treatment, e.g. the end surfaces 27, 28 and those surfaces which constitute mounting surfaces for the carrier.

Due to the axially through-going key way 47 it is a simple matter to loosen the carrier from the chamber part and the plunger piston. Thus it can easily be separately adapted to a valve spindle and possibly mounted together with this on the chamber part. Carriers belonging to an actuator can therefore be adapted to different valve spindles and form intermediate connecting pieces for adapting the actuator to different valves.

Pressure testing of the actuator can be performed without the carrier being mounted.

If the antifriction coating 46 is composed of a replaceable sliding piece, the maintenance of the actuator can be simplified.

Since those sections of the plunger piston which project into the chambers are not affected by bending moments, the plunger piston will not be deformed. Due to the clearance between the plunger piston and the chamber walls, none of the wear and leakage will occur which could have been caused by a mutually disadvantageous arrangement of these components.

The support part's end section 32, 33 which supports the packings 42–45 can be provided as loose sleeves, which can be attached separately to the chamber part's end surfaces 27, 28 after the plunger piston has been inserted into the chamber part, whereafter the support part can be connected with this chamber part-sleeve-assembly.

Even though it is a double-acting actuator which has been described above, it is obvious that it can be single-acting instead, and for instance, a device, for example a retracting spring, can be provided in order to return the plunger piston to a starting position.

Furthermore it will be understood that the carrier 3 can be mounted in the chamber part 1 in a different way and that this can have attachment flanges or the like in order to secure the chamber part to a stationary support device.

We claim:

1. A fluid-operated actuator comprising a chamber part including chamber walls and at least one chamber which is adapted to be supplied with a pressurized fluid, a carrier which is mounted in the chamber part in such a manner that it can rotate about an axis of rotation, and which is adapted to be connected with an object which has to be rotated, and a plunger piston whose longitudinal axis extends in the form of a circular arc which curves circularly about an axis which is coincident with the carrier's axis of rotation, which plunger pistion is arranged to be rotated about the axis of rotation, and to connect with the carrier, and wherein the plunger piston passes sealingly by way of a sealing device through an opening in the said at least one chamber to extend therein such that there is clearance between a section of the plunger piston which is located in the chamber and the chamber walls, and wherein a section of the plunger piston which is located outside the chamber is slidingly supported along a radial outer surface by a support part which is removably attached to the chamber part.

2. An actuator according to claim 1, wherein the sealing device comprises a sleeve which is arranged to abut against a surface of the chamber part which surrounds said opening in the chamber, said sleeve having an axially through-going passage for receiving the plunger piston, the passage including a circular packing arranged to abut against the plunger piston, and on a surface of the sleeve which faces the opening in the chamber there is provided a packing which surrounds the opening.

3. An actuator according to claim 2, wherein the sleeve is manufactured as an integral part of the support part.

4. An actuator according to claim 1, wherein a section of the support part which is arranged to slidingly support the plunger piston is supplied with an antifriction coating.

5. An actuator according to claim 1, wherein the chamber part comprises two chambers which are arranged for simultaneous engagement of respective end sections of the plunger piston.

* * * * *